United States Patent [19]

Hill

[11] 4,129,273

[45] Dec. 12, 1978

[54] KITE CONTROL MECHANISM

[76] Inventor: Donald R. Hill, 334 Huntington La., Elmhurst, Ill. 60126

[21] Appl. No.: 823,022

[22] Filed: Aug. 9, 1977

[51] Int. Cl.[2] ..... B64C 31/06; B65H 75/40

[52] U.S. Cl. ..... 244/155 A; 242/96; 242/100.1; 244/155 R

[58] Field of Search ..... 244/155 A, 155 R, 153 R, 244/153 A, 154; 242/96, 99, 100, 100.1; 46/77; 124/5; 272/31 A; D34/15 AF

[56] References Cited

U.S. PATENT DOCUMENTS

| | | | |
|---|---|---|---|
| 690,588 | 1/1902 | Krex | 242/96 |
| 1,581,289 | 4/1926 | Prihoda | 242/100 X |
| 2,388,478 | 11/1945 | Garber | 244/155 A |
| 2,499,123 | 2/1950 | White | 242/99 |
| 2,896,878 | 7/1959 | Wetzel | 242/99 |
| 3,044,732 | 7/1962 | Simonds | 242/96 |
| 3,317,165 | 5/1967 | Zobl | 244/155 R |
| 3,421,722 | 1/1969 | May et al. | 244/155 A |
| 3,620,486 | 11/1971 | Charpentier et al. | 244/153 R |

*Primary Examiner*—Barry L. Kelmachter
*Attorney, Agent, or Firm*—Wegner, Stellman, McCord, Wiles & Wood

[57] ABSTRACT

A kite control mechanism arranged to control a plurality of kite-flying lines. The mechanism includes a pair of spools mounted in a frame by a control shaft having an associated manually operable handle. The kite-flying lines extend outwardly from the spools through elongated slots in the frame and a leverage handle is mounted to the frame for supporting the mechanism during use. The spools may be driven from the mounting shaft by a key thereon selectively engaging keyways in the respective spools so as to permit driving of both spools concurrently or one spool independently of the other when desired. A friction drive device is provided for driving the second spool from the spool being driven by the shaft key so as to permit self-adjusting payout of the kite-flying lines. The second spool may be selectively locked when desired by a manually operable lock device carried on the frame. The selective driving of the spools may be effected by an axial movement of the shaft with the handle further serving to limit the axial movement in one direction. The frame of the mechanism may be flexibly constricted to provide an adjustable friction retarding force between the spools as desired.

15 Claims, 4 Drawing Figures

FIG. 1
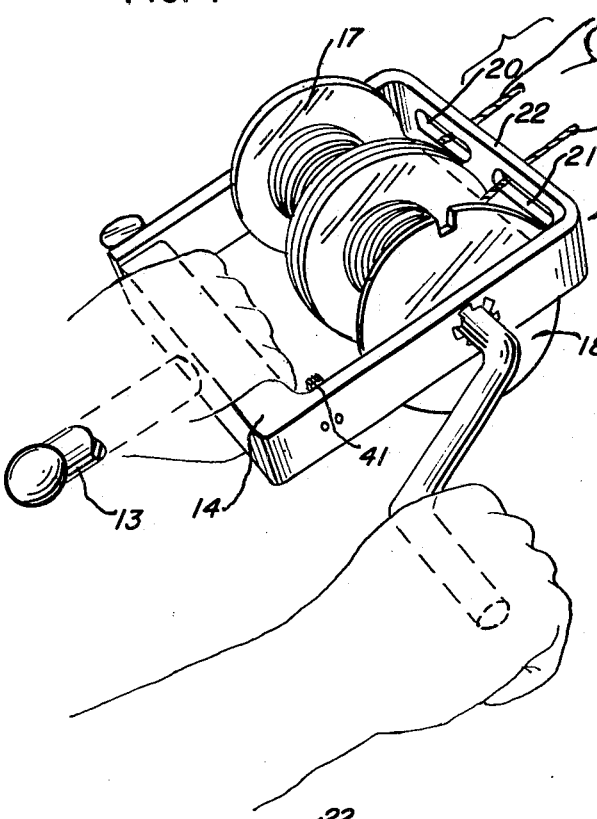
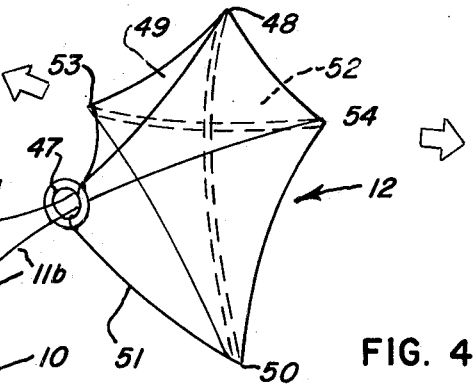
FIG. 4
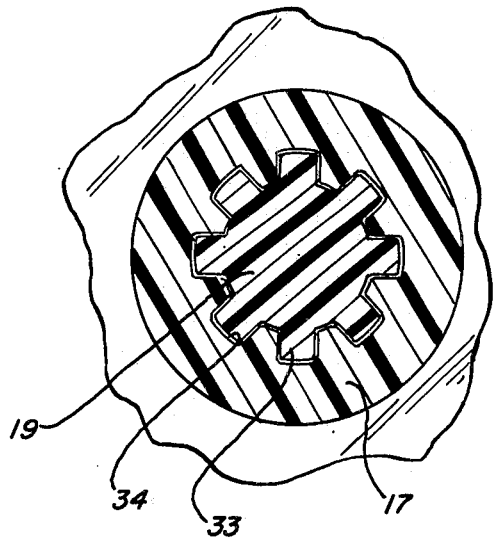
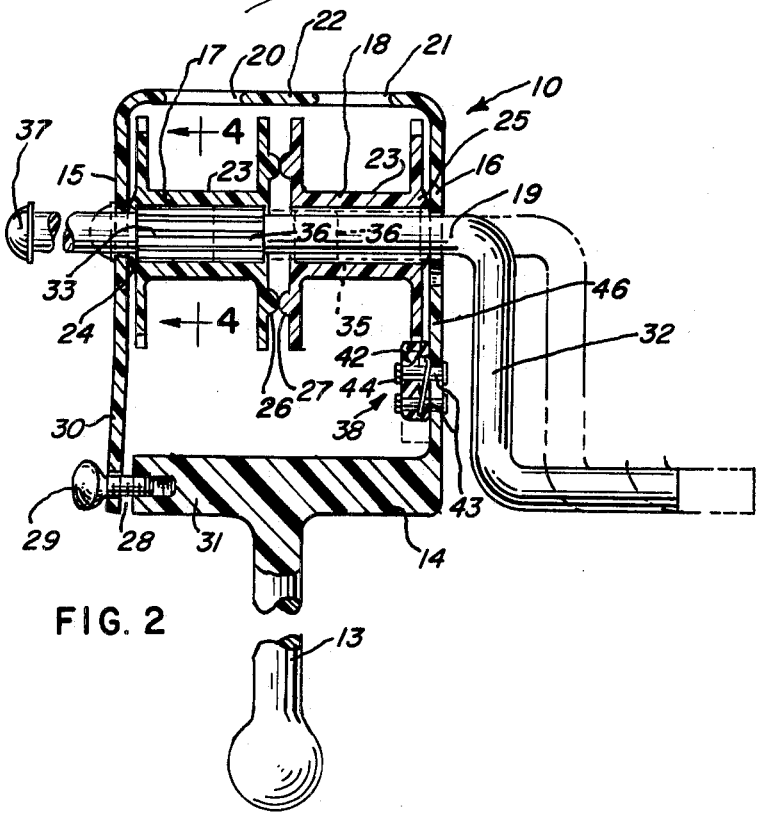
FIG. 2
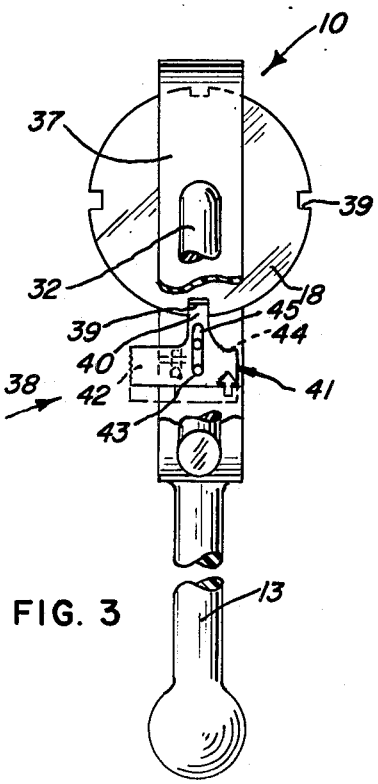
FIG. 3

KITE CONTROL MECHANISM

BACKGROUND OF THE INVENTION

1. Field of the Invention

This invention relates to kite steering mechanisms and in particular to kite steering mechanisms having a plurality of spools selectively controlled to regulate the payout and play of kite-flying lines.

2. Description of the Prior Art

A number of kite steering mechanisms have been developed for permitting facilitated control of devices, such as kites, effecting maneuvering movement thereof as well as in paying out and drawing in the kite. An example of one such device is illustrated in U.S. Pat. No. 3,338,536, of Harold L. Hull et al., which discloses a remote control device having a plurality of reels which may be selectively driven as a unit by a crank handle or independently turned by manually grasping any one wheel and exerting a desired turning moment. Maneuvering of the kite by the Hull et al. control device is effected by advancing or retarding the different elongated arms of the device, or alternatively, by manually grasping the desired reel and causing it to rotate relative to the others.

Another control device for use with kites is shown in U.S. Pat. No. 2,388,478 of Paul E. Garber, which includes free-wheeling clutches to adjust the length of the kite-flying lines. The device includes a brake for controlling the payout of the kite-flying lines ane may be used to hold the lines taut during a drum compensation operation. The brake means is used to arrest the revolving reels after paying out the line.

W. J. Thrower, in U.S. Pat. No. 2,438,188, shows a clothesline reel having a rotatable axle provided with a winding spool.

In U.S. Pat. No. 2,600,049, Alvin L. Crider shows a kite reel having a braking means including a pair of handles having relative movement thereto for effecting desired engagement of the brake shoes carried by one of the handles. The payout drum is provided with a control handle at one end of a mounting shaft thereof.

Patrick W. Simonds, in U.S. Pat. No. 3,044,732, shows a wrist reel having a winding drum provided with a cord holding a weight within a retaining socket. To release the weight, a handle mechanism is pressed inwardly against the tension of a control spring to move teeth on a sleeve from engagement with corresponding teeth on a plate of the mechanism. This releases the weight. To wind the cord back on the reel, pressure on the sleeve is released, permitting the spring to force the sleeve outwardly and bring the teeth back into interlocking engagement.

In U.S. Pat. No. 3,086,739, Theodore C. Barber shows a kite control apparatus having a plurality of outwardly extending arms with a spool mounted at the hub portion of the device for controlling kite-flying lines extending therefrom through guides at the ends of the arms whereby each of the lines may be simultaneously adjusted. In modified forms, the reels comprise separate elements which may be interconnected by suitable interlocking elements.

Yit-Chen Wong, in U.S. Pat. No. 3,652,027, shows a kite reel having a spool provided with ratchet teeth engaging ratchet teeth on a collar nonrotatably mounted on a noncircular section disposed between a handle portion of the reel and an axle extension of the handle.

SUMMARY OF THE INVENTION

The present invention comprehends an improved kite steering mechanism for controlling a plurality of kite-flying lines including a frame having spaced apart wall portions provided with coaxial journals, handle means on the frame, a control shaft rotatably and axially movably carried coaxially in the journals, a crank arm connected to said shaft for manual rotation of the shaft in the journals, first and second spools rotatably mounted on the shaft between the wall portions, and releasable means including a driver portion on the shaft, a first driven portion on the first spool, and a second driven portion on the second spool, the driver portion being selectively drivingly engageable with (a) both the driven portions and (b) the first driven portion only as an incident of axial positioning of the control shaft.

The kite steering mechanism may include friction drive means for causing the second spool to be releasably rotated with the first spool when the driver is arranged to drive only the first driven portion associated with the first spool.

Means may be provided for selectively locking the second spool against rotation, thereby permitting positive controlled maneuvering of the kite.

Means may be provided on the handle and frame for limiting the axial movement of the shaft.

The friction drive means may be actuated by adjustably positioning the wall portions of the frame axially of the shaft so as to provide an adjustable frictional retarding force between the spools.

In the illustrated embodiment, the friction drive means comprises confronting surfaces on the spools, the driving force therebetween being controlled by application of axial inward biasing force on the spools.

The biasing force may be provided by adjusting the frame configuration. In the illustrated embodiment, the frame includes a gap portion which extends parallel to the axial direction of the spools and means are provided for adjustably closing the gap to urge the wall portions carrying the spool shaft against the outer surfaces of the spools.

A thumbpiece may be provided for effecting the desired adjustment of the friction force between the spools, thereby providing for facilitated adjustment of the friction force by the operator as desired.

In the illustrated embodiment, means are provided for locking the second spool when desired, the illustrated locking means comprising a thumb portion slidably carried on the frame and cooperating teeth on the spool and locking element. Biasing means may be provided for retaining the thumb portion selectively with the teeth in interlocked or noninterlocked disposition as desired.

The kite-flying lines may extend outwardly from the spools through a pair of elongated slots in the frame. In the illustrated embodiment, the slots have a length substantially equal to the winding portion of the spools so as to permit substantially free movement of the lines from the mechanism in use.

Thus, the kite steering mechanism of the present invention is extremely simple and economical of construction while yet providing a highly desirable improved kite steering control not obtained with the mechanisms of the prior art.

BRIEF DESCRIPTION OF THE DRAWING

Other features and advantages of the invention will be apparent from the accompanying description taken in connection with the accompanying drawing wherein:

FIG. 1 is a broken perspective view illustrating the use of a kite steering mechanism embodying the invention in controlling the flight of a kite;

FIG. 2 is a front elevation thereof with portions broken away to facilitate illustration of the structure of the mechanism and with the shaft and handle portion illustrated in broken lines in an alternative disposition;

FIG. 3 is a fragmentary end elevation thereof; and

FIG. 4 is a fragmentary enlarged vertical section taken substantially along the line 4—4 of FIG. 2.

DESCRIPTION OF THE PREFERRED EMBODIMENT

In the exemplary embodiment of the invention as disclosed in the drawing, a kite steering mechanism generally designated 10 is provided for controlling a plurality of kite-flying lines 11 attached to a kite 12. Mechanism 10 includes a carrying handle 13 which, as shown in FIG. 1, may illustratively be held by one of the user's hands while the other hand is manipulating the mechanism for controlling the kite 12.

More specifically, mechanism 10 includes a frame 14 defining a pair of opposed wall portions 15 and 16 between which are disposed a plurality of spools 17 and 18. The spools are carried on a shaft 19 in coaxial relationship so as to permit movement of the lines 11 wound on spools 17 and 18 outwardly therefrom through a pair of slots 20 and 21 in an end wall 22 of the frame.

As shown in FIG. 2, the spools define winding portions 23 and the slots 20 and 21 have a length parallel to the axis of shaft 19 substantially equal to the axial dimension of the winding portions.

In the illustrated embodiment, spools 17 and 18 are captured between the wall portions 15 and 16. More specifically, spool 17 may be provided with an end boss 24 engaged by wall portion 15, and spool 18 may be provided with an opposite end boss 25 engaged by wall portion 16. The spools further define confronting annular friction ribs 26 and 27, respectively, having a relatively large radius so as to provide a desired friction drive between the spools when desired.

The friction drive is obtained by providing a suitable inward biasing action urging the wall portions 15 and 16 toward each other and thereby urging the friction ribs 26 and 27 of the spools 17 and 18 adjustably against each other. To this end, a portion of the frame 14 is caused to define a gap 28 which extends parallel to the axial direction of shaft 19. An adjusting means in the form of a friction threaded thumbscrew 29 is provided for adjustably urging the sidewall 30 of the frame toward the base portion 31 so as to adjustably close gap 28 and correspondingly urge wall 15 toward wall 16 to effect the desired frictional control between ribs 26 and 27.

Steering mechanism 10 further includes means for selectively interlocking the spools when desired. More specifically, shaft 19 is provided at one end with a manual operating handle 32 which, as shown in FIG. 1, may be rotated about the axis of the shaft portion 19 so as to correspondingly rotate the spools 17 and 18 when the spools are locked to the shaft 19. Such locking of the spools to the shaft may be effected by a key means 33 on shaft 19 comprising a plurality of circumferentially spaced, radially outwardly projecting keys slidably received in complementary keyways 34 in spool 17. Spool 18 is provided with a similar set of keyways 35 for receiving one end 36 of the key means 33 when the shaft is in a rightmost position, as shown in broken lines in FIG. 2. When the shaft is in the leftmost position, as shown in full lines in FIG. 2, key means 33 is disposed fully within the spool 17 permitting spool 18 to rotate relative to spool 17 under the controlling action of the friction clutch means 26, 27.

Selective positioning of the key means 33 is effected by axial movement of shaft 19. As shown in FIG. 2, a stop shoulder element 37 is threadedly secured to the lefthand distal end of shaft 19 for limiting the movement of the shaft to the right to the broken line position thereof. Thus, shaft 19 may be removed from mechanism 10 when desired by firstly removing element 37.

As further shown in FIG. 2, the handle 32 effectively positively limits the leftward movement of the shaft 19. As shown in FIG. 2, in the full line arrangement, the handle 32 remains spaced from the right sidewall 46 of the frame with the key means 33 disposed fully within the spool 17.

Thus, when the key means 33 is disposed to have the righthand portion 36 thereof disposed in keying association with keyway 36 of spool 18, spools 17 and 18 are locked for rotation together with shaft 19 and, thus, the lines 11 will be equally paid out or drawn in by corresponding rotation of the shaft 19 by manipulation of handle 32. If desired, the spools may be locked in this disposition by manipulation of a locking device generally designated 38. Thus, as best seen in FIG. 3, spool 18 may be provided with one or more radially outwardly opening notches 39 for selectively receiving a tooth portion 40 of a tab means generally designated 41 having a thumb portion 42 for selectively positioning the tab means. The thumb portion is slidably mounted to the frame wall 46 by suitable guide posts 43 and is biased to a retained disposition by a suitable spring 44 between the thumbpiece and frame wall portion 46. The guide posts are received in a slot 45 of the thumb portion 42 for controlling movement of the tab means toward and from the spool 18.

Thus, when it is desired to lock the spool 18 against rotation, the locking device 38 is manipulated so as to engage the tooth portion 40 with one of the notches 39 of the spool 18. The locking device is automatically retained in the locking position by the spring 44 and, thus, maintains the spool 18 locked against rotation.

If the shaft 19 is disposed as shown in broken lines at this time, neither of the spools 17 nor 18 may be rotated and rotation of the shaft 19 is effectively prevented.

Movement of the shaft 19 to the full line position of FIG. 2, however, when the spool 18 is locked by locking device 38, permits controlled rotation of the spool 17 against the frictional retarding force of friction clutch 26, 27. Thus, the kite may be maneuvered to the left or right or caused to dive, depending on the rotation of shaft 19 by handle 32 under these conditions.

With the shaft 19 in the leftward full position of FIG. 2, and with the locking device 38 in the nonlocking disposition wherein tooth portion 40 thereof is withdrawn from the notch 39 of spool 18, rotation of both spools 17 and 18 may be concurrently effected by the positive driving of spool 17 by shaft 19 and the friction driving of spool 18 from spool 17 by the friction clutch means 26, 27. As the drive between the spools is a friction drive, uneven winding of the lines on the spools is automatically accommodated by the permissible relative movement between the spools while at the same time, generally similar payout or takin of the lines is effected by the manipulation of handle 32 and rotation of shaft 19 thereby.

The location of locking device 38 relative to handle 13 may be preselected so as to permit the user to use the thumb of the hand grasping frame portion 31 and handle 13 to effect the desired disposition of the locking device.

In the illustrated embodiment, the frame and handle are formed integrally as a molding of synthetic resin. Gap 28 may be formed in the molded frame or may be cut therefrom as desired. As further shown in FIG. 2, the handle 32 may be formed integrally with the shaft 19, defining a bent end portion thereof. The elements of mechanism 10 may be formed of a suitable strong rigid material, such as metal, or molded synthetic resin, etc. Thus, the construction of the kite steering mechanism 10 is extremely simple and economical while yet providing the facilitated kite steering action discussed above.

As further shown in FIG. 1, the invention comprehends an improved means for controlling the flight of kite 12 by manipulation of mechanism 10 to adjust the payout of lines 11. As shown therein, lines 11 include a left line 11*a* and a right line 11*b*. A control ring 47 is connected to the upper corner 48 of the kite by a first connecting line 49 and to the lower corner 50 of the kite by a second connecting line 51. The length of connecting lines 49 and 51 may be adjusted to vary the disposition of the control ring relative to the vertical extent of the kite, i.e. relative to the crossbow 52 to thereby control the altitude of the flown kite.

As further shown in FIG. 1, left control line 11*a* is passed through ring 47 and connected to left corner 53 of the kite and line 11*b* is passed through control ring 47 and connected to the right corner 54 of the kite. Thus, the use of the improved control ring arrangement provides further improved facility in controlling the flight of the kite by suitable manipulation of mechanism 10 as discussed above.

The foregoing disclosure of specific embodiments is illustrative of the broad inventive concepts comprehended by the invention.

I claim:

1. A kite steering mechanism for controlling a plurality of kite-flying lines, said mechanism comprising:

a frame having spaced apart wall portions provided with coaxial journals;

handle means on the frame;

a control shaft rotatably and axially movably carried coaxially in said journals;

a crank arm connected to said shaft for manual rotation of the shaft in said journals;

first and second spools rotatably mounted on said shaft between said wall portions; and releasable means including a driver portion on said shaft, a first driven portion on said first spool and a second driven portion on said second spool, said driver portion being selectively drivingly engageable with (a) both said driven portions, and (b) said first driven portion only as an incident of axial positioning of the control shaft, said releasable means including friction drive means on said spools for causing said second spool to be driven releasably with said first spool means when said driver portion is arranged to drive only said first driven portion on the first spool, and means for adjusting said friction drive means to provide an effective frictional interlock between said spools.

2. The kite steering mechanism of claim 1 wherein means are provided for selectively locking said second spool against rotation.

3. The kite steering mechanism of claim 1 wherein cooperating means are provided on said control shaft and frame for limiting the axial movement of said shaft.

4. The kite steering mechanism of claim 1 wherein means are provided for selectively locking said second spool against rotation comprising means on said second spool defining a radially outwardly opening notch, and tab means movably carried on said frame for reception selectively in said notch.

5. The kite steering mechanism of claim 1 wherein means are provided for selectively locking said second spool against rotation comprising means on said second spool defining a radially outwardly opening notch, and tab means movably carried on said frame for reception selectively in said notch, said tab means including a thumb portion slidably carried by said frame, a tooth portion selectively receivable in said notch, and biasing means for retaining said tab means selectively with said tooth portion (a) outwardly of said notch and (b) received in said notch.

6. The kite steering mechanism of claim 1 wherein said spools define line winding portions and said frame defines first and second elongated slots for passing the kite lines wound on said spools outwardly to the kite being controlled by the mechanism, said slots extending parallel to and having a length substantially equal to said line winding portions of the spools.

7. The kite steering mechanism of claim 1 wherein said driver portion comprises key means on said shaft and said driven portions comprise keyways on said spools.

8. The kite steering mechanism of claim 1 wherein said driver portion comprises key means on said shaft and said driven portions comprise keyways on said spools, said shaft being further provided with shoulder means for manually positioning the shaft with said driver portion by means selectively received in (a) both said keyways, and (b) said keyway of said first spool only.

9. The kite steering mechanism of claim 1 including a kite having an upper corner, a lower corner, a right corner, and a left corner, said kite flying lines including a first control line, and a second control line, and said mechanism further including means for selectively controlling the payout of the control lines, a control member defining a hole, first connecting means for connecting the control member in a preselected disposition between said upper and lower corners of the kite, said control lines passing freely through said control member hole, and second connecting means connecting the distal end of said first control line to the left corner of the kite and the distal end of the second control line to the right corner of the kite, said first connecting means comprising a pair of connecting lines, one of which is connected between the control member and said kite upper corner and the other of which is connected between the control member and said kite lower corner.

10. The kite steering control of claim 9 wherein said control member comprises a ring.

11. The kite steering control of claim 9 wherein said kite defines a crossbow extending between said left and right corners, and said first connecting means is arranged to dispose the control member above the level of the crossbow.

12. A kite steering mechanism for controlling a plurality of kite-flying lines, said mechanism comprising:

a frame having spaced apart wall portions provided with coaxial journals;

handle means on the frame;

a control shaft rotatably and axially movably carried coaxially in said journals;

a crank arm connected to said shaft for manual rotation of the shaft in said journals;

first and second spools rotatably mounted on said shaft between said wall portions;

releasable means including a driver portion on said shaft, a first driven portion on said first spool and a second driven portion on said second spool, said driver portion being selectively drivingly engageable with (a) both said driven portions, and (b) said first driven portion only as an incident of axial positioning of the control shaft, said releasable means including coacting friction drive means on said spools for causing said second spool to be releasably rotated by said first spool when said driver portion is arranged to drive only said first driven portion; and means for adjustably urging said wall portions axially of said shaft to provide an adjustable frictional interlock between said spools by said friction drive means.

13. A kite steering mechanism for controlling a plurality of kite-flying lines, said mechanism comprising:

a frame having spaced apart wall portions provided with coaxial journals;

handle means on the frame;

a control shaft rotatably and axially movably carried coaxially in said journals;

a crank arm connected to said shaft for manual rotation of the shaft in said journals;

first and second spools rotatably mounted on said shaft between said wall portions;

releasable means including a driver portion on said shaft, a first driven portion on said first spool and a second driven portion on said second spool, said driver portion being selectively drivingly engageable with (a) both said driven portions, and (b) said first driven portion only as an incident of axial positioning of the control shaft, said frame defining a gap extending parallel to the axis of said shaft; and means for adjustably closing said gap to urge said wall portions forcibly toward each other and into frictional engagement with said spools.

14. The kite steering mechanism of claim 13 wherein said spools are further provided with cooperating confronting friction drive means for causing said second spool to be releasably rotated with said first spool when said driver portion is arranged to drive only said first driven portion.

15. The kite steering mechanism of claim 13 wherein said means for adjustably closing the gap comprises a manually operable thumbscrew threaded to said frame across said gap.

* * * * *